US008900673B2

(12) United States Patent
Chen et al.

(10) Patent No.: US 8,900,673 B2
(45) Date of Patent: Dec. 2, 2014

(54) LONG-LASTING WATER-REPELLENT TEXTILE TREATMENT PROCESS USING UV-CURABLE POLYDIMETHYLSILOXANE-CONTAINING POLYURETHANE SYSTEM

(71) Applicant: Tamkang University, Taipei County (TW)

(72) Inventors: Wei-hung Chen, New Taipei (TW); Po-cheng Chen, New Taipei (TW); Shih-chieh Wang, Taipei County (TW); Kan-nan Chen, Taipei County (TW)

( * ) Notice: Subject to any disclaimer, the term of this patent is extended or adjusted under 35 U.S.C. 154(b) by 1 day.

(21) Appl. No.: 13/848,371

(22) Filed: Mar. 21, 2013

(65) Prior Publication Data

US 2013/0209699 A1 Aug. 15, 2013

Related U.S. Application Data

(62) Division of application No. 12/505,504, filed on Jul. 19, 2009, now abandoned.

(51) Int. Cl.

| | |
|---|---|
| ***B05D 3/06*** | (2006.01) |
| ***D06M 15/564*** | (2006.01) |
| ***D06M 15/643*** | (2006.01) |
| ***D06M 15/653*** | (2006.01) |

(52) U.S. Cl.

CPC ..... *B05D 3/067* (2013.01); *D06M 15/564* (2013.01); *D06M 15/6436* (2013.01); *D06M 15/653* (2013.01); *D06M 2200/12* (2013.01)

USPC ..... 427/513

(58) Field of Classification Search

CPC ..... D06M 15/564; D06M 15/6436; D06M 15/653; D06M 2200/12; B05D 3/061; B05D 3/067

USPC ..... 427/513

See application file for complete search history.

(56) References Cited

U.S. PATENT DOCUMENTS 4,174,307 A * 11/1979 Rowe ..... 522/96
6,162,862 A * 12/2000 Grunbauer et al. ..... 524/590

* cited by examiner

*Primary Examiner* — Elena T Lightfoot
(74) *Attorney, Agent, or Firm* — Chun-Ming Shih

(57) ABSTRACT

A long-lasting water-repellent textile treatment process using a curable polydimethylsiloxane (PDMS)-containing polyurethane (PU) system includes the steps of mixing a di-isocyanate with a PDMS-containing material, and reacting the di-isocyanate with the PDMS-containing material to form an NCO-terminated PDMS-containing PU system. The treatment process obtains a long-lasting water-repellent textile, which overcomes the shortcomings in hand feel, washing durability, and breathability of the conventional water-repellent textile, while having the advantages of low cost and of being an environmentally friendly process, while also providing useful and practical industrial applications.

7 Claims, 7 Drawing Sheets

KF-6001 ( for PU-M )

X-22-176DX ( for PU-S )

KF-6001 ( for PU-M )

X-22-176DX ( for PU-S )

UV-PU-M

UV-PU-S

LONG-LASTING WATER-REPELLENT TEXTILE TREATMENT PROCESS USING UV-CURABLE POLYDIMETHYLSILOXANE-CONTAINING POLYURETHANE SYSTEM

CROSS-REFERENCE TO RELATED APPLICATIONS

This application is a Divisional of application Ser. No. 12/505,504, filed on Jul. 19, 2009, which claims priority of Application No. 097139375 filed in Taiwan on Oct. 14, 2008 under 35 U.S.C. §119; the entire contents of all are hereby incorporated by reference.

BACKGROUND OF THE INVENTION

1. Field of Invention

The present invention relates to a long-lasting water-repellent textile treatment process using an ambient temperature curable polydimethylsiloxane (PDMS)-containing polyurethane (PU) system, and the treatment process includes a predetermined process to obtain a long-lasting water-repellent textile, so as to overcome the shortcomings including poor hand feel, washing durability, and breathability of the conventional water-repellent textile, while having the features of a low cost and an environmental friendly process, and providing useful and practical industrial applications.

2. Description of Related Art

In recent years, new functional textile is a market trend to provide more healthy and comfortable clothes, particularly developing textiles with anti-bacterial, water-absorbent, temperature-regulating and water-repellent functions to meet the requirements for the applications in different fields such as outdoor sports, transportations, casual wears, medical protection garments, and etc. For outdoor sports and medical protection garments, the function of a water repellent effect (with a hydrophobic characteristic) and breathability are becoming absolutely necessary.

In present water-repellent textile manufacturing technologies, a fluorine-containing substance with high electronegativity is generally used as a recipe for the water-repellent surface modification. Since fluorine comes with small atomic radius and high electronegativity which can reduce the surface energy of substance effectively, therefore a conventional fluorine-containing water repellent (such as a fluorine-containing acrylic resin) can be applied or a polyvinyl difluoride (PVDF) or Teflon film can be attached onto the surface of fabrics to achieve the water-repellent effect. However, the prior art has the following drawbacks:

1. Poor Hand Feel: A water repellent layer is coated onto a textile surface for achieving the water repellent effect in accordance with the prior art. However, the water repellent will form a film on the textile surface to harden the textile, and thus giving a poor hand feel.

2. Poor Breathability: The water repellent material is coated to form a continuous film onto the textile surface, and thus the textile breathability is blocked or reduced, and it is the main reason why present water-repellent textiles can be used for jackets and canvas only.

3. Low Durability: The conventional water-repellent textile coats the water repellent to form a film adhered on top of textile surface, such that after several times of use, rubbing and washing, the water-repellent function will be reduced easily due to the worn-out or de-lamination of the water-repellent film.

4. High Cost: The products in accordance with the prior art are using expensive water-repellent films and processed at a complicated processes.

5. Incompliant with Environmental Friendliness: Fluorine-containing polymer film (fluorine-containing acrylate resins, polyvinyl difluoride, PVDF or others) is used in the prior art, regardless of the film adhesion onto the textile, which is not an environmental friendly product.

The aforementioned drawbacks and disadvantages of the prior art demands immediate attentions and feasible solution.

SUMMARY OF THE INVENTION

In view of the foregoing shortcomings of the prior art including the poor hand feel, low durability, poor breathability, high cost and incompliant with environmental friendliness, the inventors of the present invention based on years of experience in the related field to conduct extensive researches and experiments, and finally developed a long-lasting water-repellent textile treatment process using an ambient temperature curable PDMS-containing PU in accordance with the present invention to overcome the shortcomings of the prior art.

Therefore, it is a primary objective of the present invention to provide a long-lasting water-repellent textile treatment process that uses an ambient temperature curing technology, such as moisture- or UV-curable polyurethane (PU) system to be thinly coated onto the textile surface by spraying, gravure printing, dipping, knife coating or scraping, so as to obtain a water-repellent textile with a good hand feel, a long-lasting washing durability and a good breathability. In addition, the long-lasting water-repellent textile treatment process of the present invention has the advantages of the ambient temperature curable PDMS-containing PU is an environmental friendly product. Furthermore, the textile water-repellent treatment by a moisture- or UV-curing process is carried out at an ambient temperature only and exposed to air or UV-radiation.

BRIEF DESCRIPTION OF THE DRAWINGS

The invention, as well as its many advantages, may be further understood by the following detailed description and drawings in which.

DETAILED DESCRIPTION OF THE INVENTION

To make it easier for our examiner to understand the technical measures and the operating procedure of the present invention, we use preferred embodiments together with the attached drawings for the detailed description of the present invention.

Figure 2:
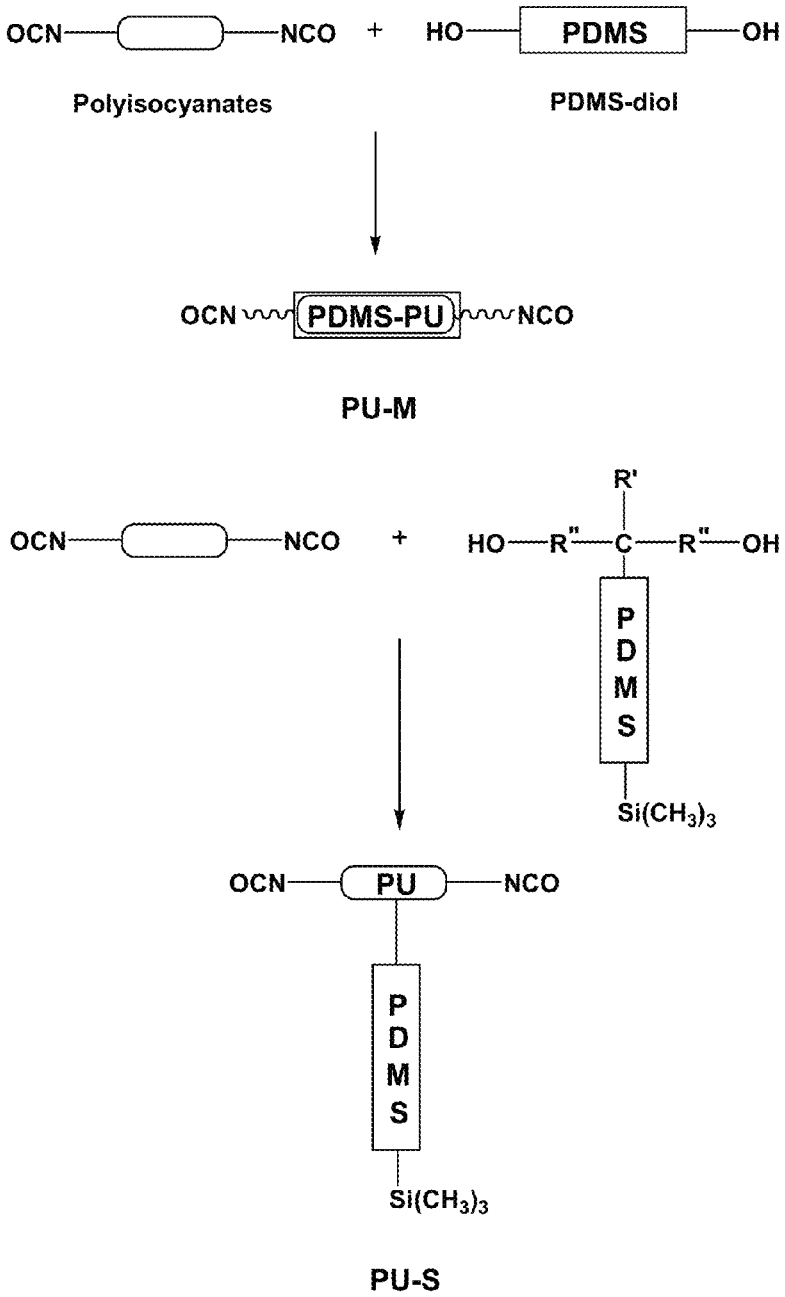
FIG. 2 is a flow chart of a long-lasting water-repellent textile treatment process using a moisture curable PDMS-containing PU system (PU-M, PU-S) in accordance with the present invention.

The present invention discloses a long-lasting water-repellent textile treatment process using an ambient temperature curable PDMS-containing PU, and the ambient temperature curable PDMS-containing PU of the invention refers to a moisture-curable PDMS-containing PU system and an UV-curable PDMS-containing PU system. With reference to FIG. 2 for a flow chart of a preferred embodiment of the present invention, a long-lasting water-repellent textile treatment process using a moisture-curable PDMS-containing PU system (PU-M, PU-S, or their hybrid PU-$M_1S_1$) comprises the following steps:

Step 1 (Synthesis): Place a predetermined quantity of polydimethylsiloxane (PDMS) diol (e.g., KF-6001 as PU main-chain; X-22-176DX as PU side-chain) into a reaction flask, and add a catalyst into the reaction flask and mix the catalyst with the PDMS, wherein the predetermined quantity is equal to 100 g, 0.03 mole.

Figure 1:
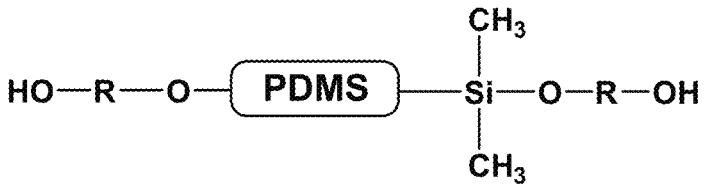
FIG. 1 shows a chemical structure of each polydimethylsiloxane (PDMS)-diol (e.g., KF-6001 as PU main-chain; X-22-176DX as PU side-chain) for ambient temperature curable hydrophobic PU system (referred as PU-M, for main chain; as PU-S, for side chain) of the present invention.
Figure 1:
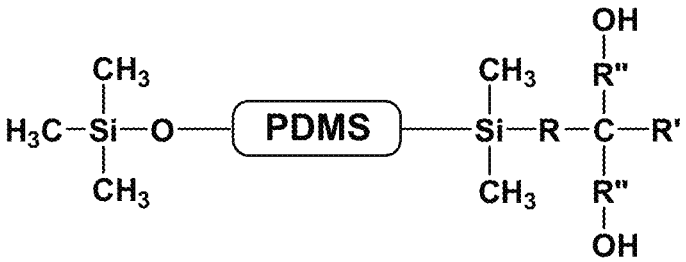

In the first preferred embodiment, the PDMS material is a PU main-chain alkylhydroxyl-terminated PDMS KF-6001 (hereinafter referred to as "KF-6001", FIG. 2A) whose chemical structure is shown in FIG. 1 and its molecular weight is 1800, and the catalyst is dibutyltin dilaurate (DBTDL) with a concentration of 0.1%.

Step 2: Adding and Mixing Di-isocyanate: Slowly drop another predetermined quantity of di-isocyanate into the reaction flask, while controlling the reaction temperature below a predetermined temperature (which is 90° C. in this embodiment), and complete preparing a NCO-terminated main-chain PDMS-containing PU oligomer (PU-M) after the reaction has taken place for a predetermined time (which is equal to 12 hours in this embodiment), and the foregoing predetermined quantity is 8.0 g, 0.036 mole, and the di-isocyanate of the first preferred embodiment is isophorone diisocyanate (IPDI). The preparation of PU with PDMS as a side chain is the same process as using PU-M with PDMS (X-22-176DX) to replace KF-6001 as PU side-chain (PU-S). Their hybrid, PU-$M_1S_1$ is using a mixture of X-22-176DX and KF-6001 (in a ratio of 1:1) as the PDMS diol raw material.

Step 3: Embedding textile fibers: Dilute a predetermined weight (which is 6.0 g) of the PU-M (PU-S or PU-$M_1S_1$) by an organic solvent to produce another predetermined weight (which is 48 g) of solution, and coating the solution onto a surface of a textile (such as polyethylene terephthalate, PET, cotton or nylon) by a spraying method, and dry the textile in the air to obtain a long-lasting water-repellent textile of the present invention, and the aforementioned organic solvent is acetone.

Figure 3:
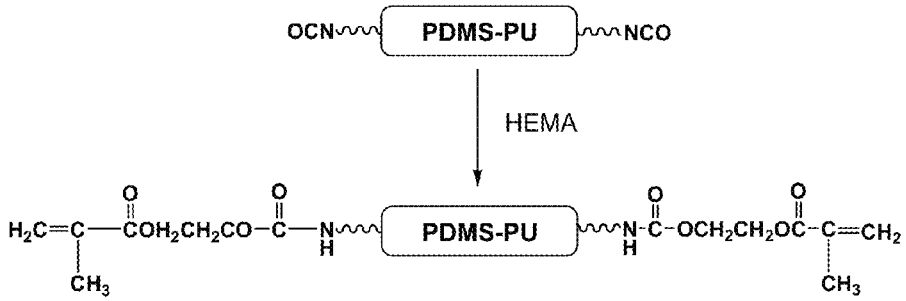
FIG. 3 is a flow chart of a long-lasting water-repellent treatment process applying an UV-curable PDMS PU system (UV-PU-M, UV-PU-S and their hybrid UV-PU-$M_1S_1$) on a textile in accordance with the present invention.
Figure 3:
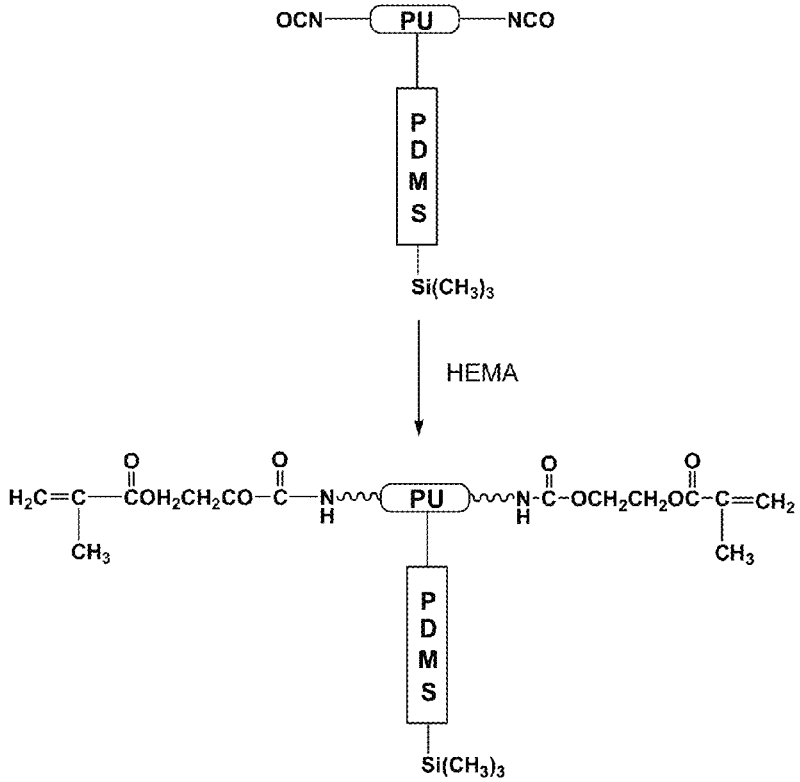

With reference to FIG. 3 for a flow chart of another preferred embodiment of the present invention, the long-lasting water-repellent treatment process applying an UV-curable PDMS in a textile comprises the following steps:

Step 1 (Synthesis): Place a predetermined quantity of polydimethylsiloxane (PDMS) into another reaction flask, add a catalyst into the reaction flask, and mix the catalyst with the PDMS, wherein the predetermined quantity is equal to 90 g, 0.05 mole. In the second preferred embodiment, the PDMS material is a side-chain alkylhydroxyl-terminated PDMS (e.g. X-22-176DX) for the whose PU-S chemical structure is shown in FIG. 1 and its molecular weight is 1600, and the catalyst is dibutyltin dilaurate (DBTDL) with a concentration of 0.1%.

Step 2 (Adding and Mixing Di-isocyanate): Slowly drop another predetermined quantity of di-isocyanate into the reaction flask, while controlling the reaction temperature at a predetermined temperature until the reaction ends, wherein the foregoing predetermined quantity is 0.036 mole, and the predetermined temperature is 80° C.

Step 3 (Adding a hydroxyl-containing acrylate monomer): Drop an appropriate quantity of hydroxyl-containing acrylate monomer into the reaction flask after the foregoing reaction ends, while maintaining the temperature at a predetermined temperature until the reaction completes, so as to complete preparing a PDMS as an UV-curable PU side-chain system (which is a water-repellent material, UV-PU-S), and the aforementioned hydroxyl-containing acrylate is 2-hydroxyethylmethacrylate (HEMA).

Step 4 (Embedding textile fibers): Mix the UV-PU-S with a photoinitiator uniformly, and dilute the mixture to an appropriate concentration, and coat the mixture onto a surface of a textile (such as polyethylene terephthalate (PET), Cotton or nylon) by a spraying method, wherein the photoinitiator is 1.0 phr photo-initiator, such as 2-hydroxy-2-methylpropionphenone (DARCUR 1173).

Step 5 (UV-radiation curing reaction): Finally, the coated textile is irradiated with an UV light (provided by a medium-pressure mercury lamp) for a predetermined time (which is equal to 15 seconds in this embodiment) and until it is dried, so as to obtain a long-lasting water-repellent textile of the present invention.

In a third preferred embodiment of the present invention, the UV light radiation onto the mixed PDMS containing PU is applied to another manufacturing process for a long-lasting water-repellent treatment of the textile:

Step 1 (Synthesis): Mix a PDMS material (e.g. KF-6001) as a PU main-chain (PU-M) with another PDMS material (e.g. X-22-176DX) as a PU side-chain (PU-S) in a predetermined proportion (which is equal to 1:1 in this embodiment), and place the mixture into a reaction flask, and add and mix a catalyst with the mixture. In the third preferred embodiment, the siloxane containing material is a main-chain alkylhydroxyl-terminated PDMS KF-6001 (hereinafter referred to as KF-6001), and the other PDMS material is a side-chain alkylhydroxyl-terminated PDMS X-22-176DX, and the catalyst is dibutyltin dilaurate (DBTDL) with a concentration of 0.1%.

Step 2 (Adding and mixing a di-isocyanate): Slowly drop the di-isocyanate into the reaction flask, while controlling the reaction at a predetermined temperature for a predetermined time, wherein the foregoing di-isocyanate is isophorone diisocyanate (IPDI), and the predetermined temperature is equal to 80° C., and the predetermined time is equal to 12 hours.

Step 3 (Adding a hydroxyl-containing acrylate): Drop an appropriate quantity of hydroxyl-containing acrylate (e.g. HEMA) into the reaction flask, while maintaining the temperature at a predetermined temperature until the reaction ends, so as to complete preparing a mixed PU oligomer (which is a water-repellent material, PU-$M_1S_1$), and the aforementioned hydroxyl-containing acrylate is 2-hydroxyethylmethacrylate (HEMA). Step 4 (Embedding textile fibers): Mix the PU-$M_1S_1$ with a photoinitiator, and dilute the mixture to an appropriate concentration, and coat the mixture onto a surface of a textile (such as polyethylene terephthalate, PET, cotton or nylon) by a spraying method, wherein the photoinitiator is 1.0 phr of 2-hydroxy-2-methylpropionphenone (DARCUR 1173).

Step 5 (UV-curing): Finally, the coated textile is irradiated with an UV light (provided by a medium-pressure mercury lamp) continuously for a predetermined time (which is equal to 15 seconds in this embodiment) and dried, so as to obtain a long-lasting water-repellent textile of the present invention.

The following tests show that the textile going through the treatment process in accordance with the present invention definitely has the effect of a long-lasting water-repellent treatment. The moisture-cured PU-M, PU-S and PU-$M_1S_1$ on treated textiles have similar results corresponding to the treated textile with UV-PU-M, UV-PU-S and UV-PU-M, respectively. Therefore, the results indicate the following that emphasize on the moisture-curing process only.

1. Contact Angle Test

Contact angles of de-ionized water droplets on the treated textile surface were measured after 30 seconds of every water droplet applied at ambient temperature. Five measurements for each sample were performed, and three closest readings were chosen and averaged for the mean value. The contact angle was calculated by the following equation:

$$\text{Contact Angle}=2\tan^{-1}(h/r),$$

where, h is height of the spherical segment of the water droplet and r is the radius of the spherical segment.

The contact angle test examines the appearance of water drops on textile surface. The "water repellency" refers to the contact angle greater than 90 degrees, such that the liquid forms a spherical droplet on flat surface and rolling down from textile when the surface is tilted. Therefore, the larger the contact angle, the higher is the water repellency of surface.

In the second and third preferred embodiments (moisture-curing and UV-curing), water droplets are dropped on the surface of textiles which are coated with the PU-M and the PU-$M_1S_1$ at room temperature respectively, and the contact angle value of each treated textile is obtained. The PETs are treated with PU-M and PU-S, and their contact angles are 116° and 120°, respectively. However, PU-$M_1S_1$ treated PET has a contact angle of 128°. It has a higher contact angle value on the treated nylon with PU-$M_1S_1$ compared with the nylon treated with PU-M or PU-S. These are due to a micro-phase separation of two non-compatible (different polarity) main-chain and side-chain PDMS on their PU hybrid (PU-$M_1S_1$) that drives the PDMS moiety out to the top of the treated textile, and enhances the hydrophobic textile surface.

2. Washing Durability Test

The International Standard AATCC Test Method 135-2004 is used for performing a water washing cycle for the processed textile, and the contact angle measurement with respect to the washed textile surface is measured to determine the washing durability of the textile processed by the treatment process of the present invention. The aforementioend washing durability test is performed for polyethylene terephthalate (PET) and nylon coated with PU-$M_1S_1$ respectively, and the test results are listed in the following table:

| Number of Washing cycles[b] | 0[a] | 30 | 50 |
|---|---|---|---|
| Contact Angle (°) of Polyethylene Terephthalate (PET) with respect to water washing cycles | 128[a] | 126 | 126 |
| Contact Angle (°) of Nylon with respect to water washing cycles | 131[a] | 130 | 130 |

Notes:
[a]contact angle on treated textile before water washing
[b]water washing cycles (30 and 50 cycles) performed by the International Standard AATCC Test Method 135-2004

In the table, we can observe that the contact angles of water drop with respect to the coated polyethylene terephthalate (PET), cotton and nylon are still remained after the PET and nylon have been washed for 50 cycles, and thus the PET and nylon processed by the treatment process of the present invention concurrently have the washing durability and high water repellency properties, since the curing reaction has been taken place and anchored onto the textile.

3. Observations of Scanning Electron Microscope (SEM) Micrographs

Figure 4A:
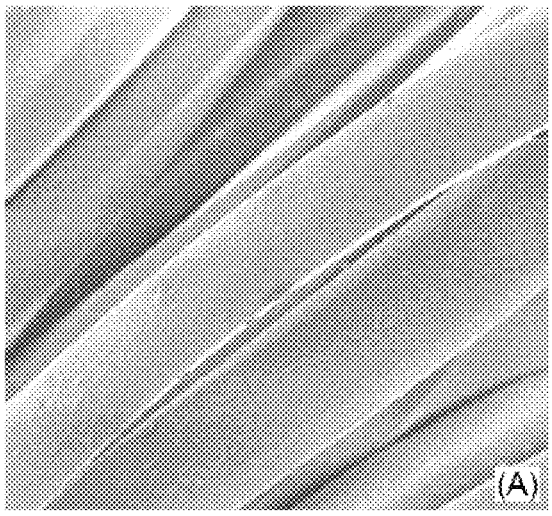
FIG. 4A shows a scanning electron microscope (SEM) micrograph of original polyethylene terephthalate (PET) before a water-repellent PU treatment takes place in accordance with the present invention.
Figure 4B:
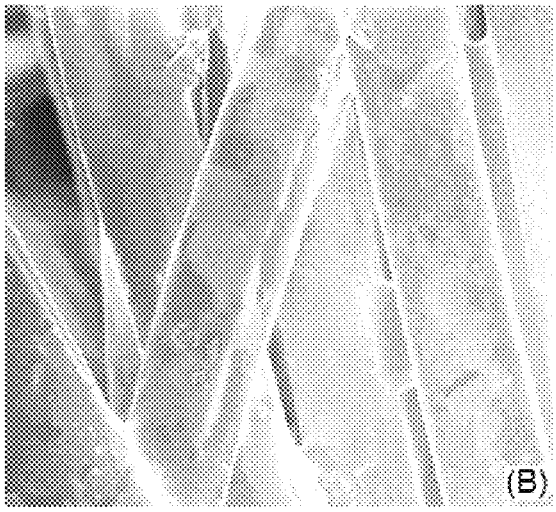
FIG. 4B shows a scanning electron microscope (SEM) micrograph of polyethylene terephthalate (PET) coated with PU-$M_1S_1$ in accordance with the present invention.
Figure 4C:
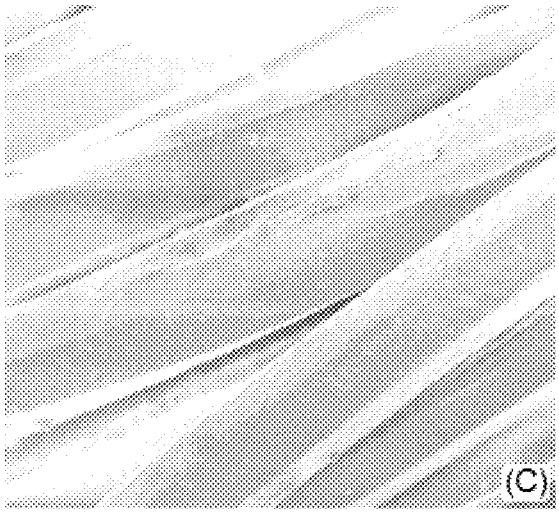
FIG. 4C shows a scanning electron microscope (SEM) micrograph of polyethylene terephthalate (PET) coated with PU-$M_1S_1$ and after 10 washing cycles in accordance with the present invention.
Figure 5A:
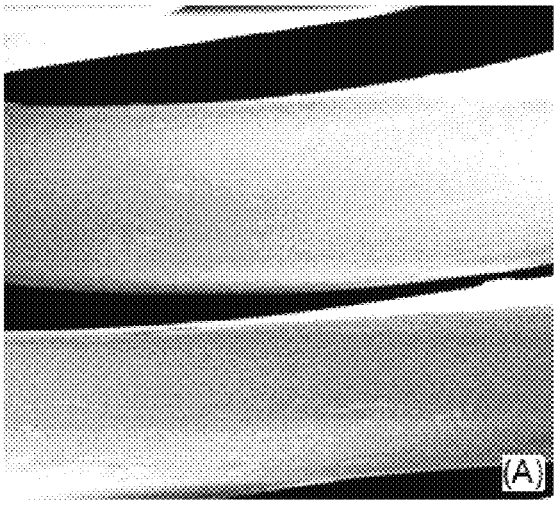
FIG. 5A shows a scanning electron microscope (SEM) micrograph of original nylon before a water-repellent PU treatment takes place in accordance with the present invention.
Figure 5B:
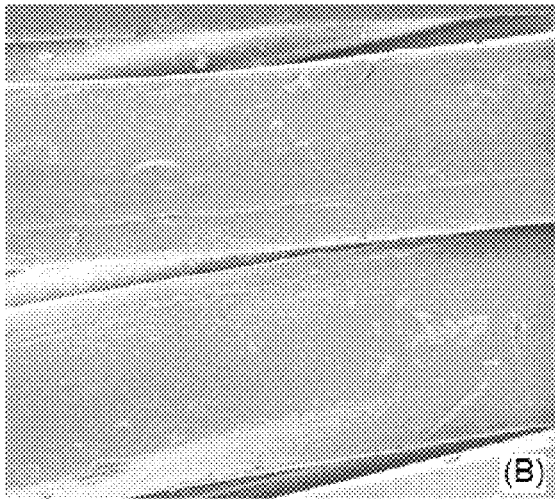
FIG. 5B shows a scanning electron microscope (SEM) micrograph of nylon coated with PU-$M_1S_1$ in accordance with the present invention.
Figure 5C:
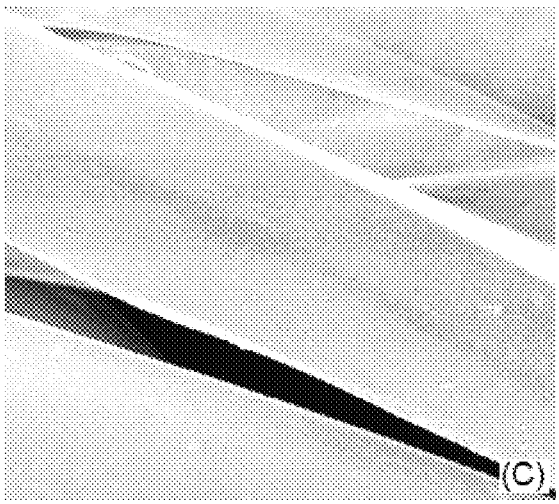
FIG. 5C shows a scanning electron microscope (SEM) micrograph of nylon coated with PU-$M_1S_1$ and after 10 water washing cycles, in accordance with the present invention.

With reference to FIGS. 4 and 5 for a third preferred embodiment of the present invention, the polyethylene terephthalate (PET) and nylon are coated with the PU-$M_1S_1$, and then a scanning electron microscope (SEM) is used for observing the effect of the coating process on textile fibers. FIG. 4A shows an original polyethylene terephthalate (PET); FIG. 4B demonstrates the coated polyethylene terephthalate (PET), which has the contact angle at 128°; FIG. 4C shows that a coated PET after 10 water washing cycles has a contact angle remained unchanged; FIG. 5A shows an original nylon; FIG. 5B demonstrates the coated nylon, which has a contact angle of 131°; and FIG. 5C shows the coated nylon after 10 water washing cycles, and its contact angle is almost the same. The results indicate that the PU-$M_1S_1$ is coated onto surfaces of the textile fibers but not forming a continuous film and having a coated material remained on the fiber surface after 10 water washing cycles. And it demonstrates that the treated textile by the present invention is water washing resistant.

4. Water Absorption Test

Figure 6A:
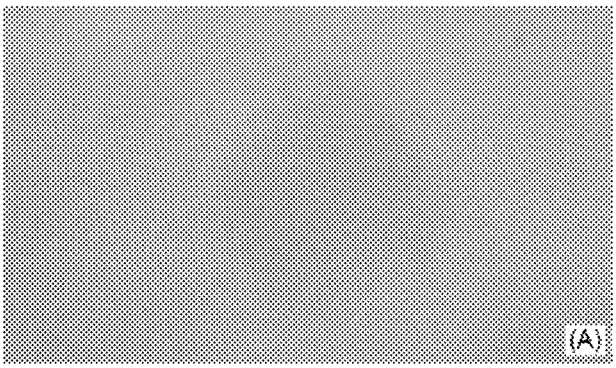
FIG. 6A shows a photo of water drops on textile surface of original polyethylene terephthalate (PET) in accordance with the present invention.
Figure 6B:
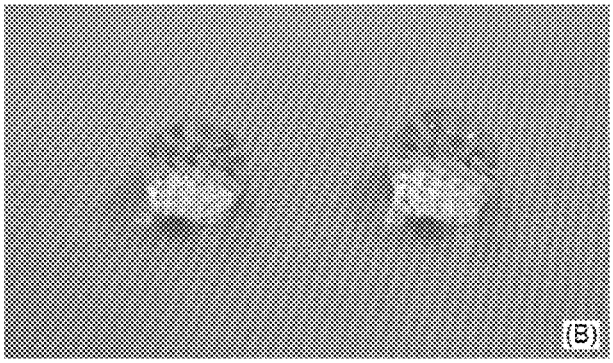
FIG. 6B shows a photo of water drops on textile surface of polyethylene terephthalate (PET) coated with PU-$M_1S_1$ in accordance with the present invention.
Figure 6C:
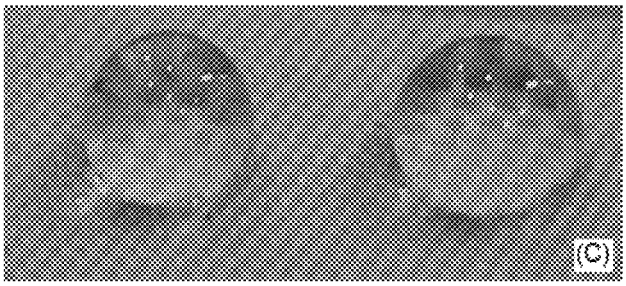
FIG. 6C shows a photo of water drops on textile surface of polyethylene terephthalate (PET) coated with PU-$M_1S_1$ and after 10 water washing cycles in accordance with the present invention.
Figure 7A:
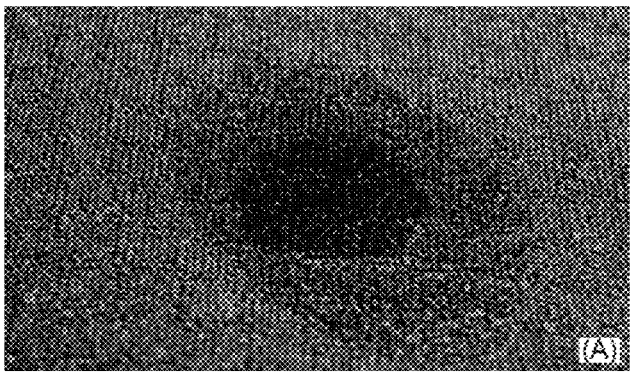
FIG. 7A shows a photo of water drops on textile surface of original nylon in accordance with the present invention.
Figure 7B:
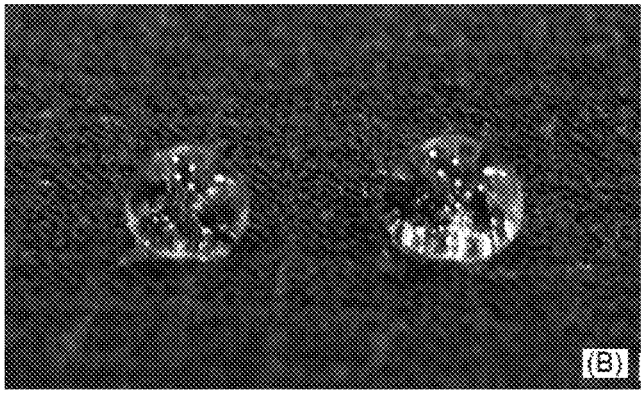
FIG. 7B shows a photo of water drops on textile surface of nylon coated with PU-$M_1S_1$ in accordance with the present invention.
Figure 7C:
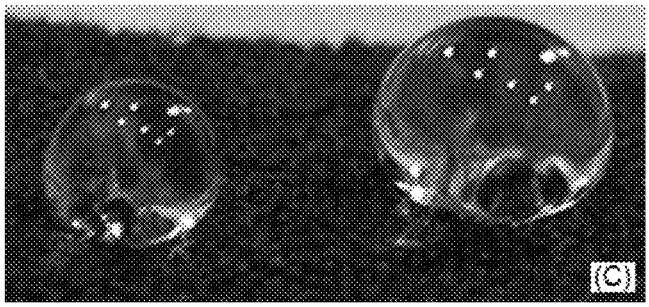
FIG. 7C shows a photo of water drops on textile surface of nylon coated with PU-$M_1S_1$ and after 10 water washing cycles in accordance with the present invention.

With reference to FIGS. 6 and 7 for the photos of water droplets on surfaces of polyethylene terephthalate (PET) and nylon respectively, FIG. 6A exhibits that water drops spread out (water is absorbed completely) as long as the water drops touch the original polyethylene terephthalate (PET); FIGS. 6B and 6C demonstrate that the water droplets on the coated polyethylene terephthalate (PET) with PU-$M_1S_1$, (it has contact angle 128°) before and after water washing cycles; FIG. 7A exhibits the water drops are absorbed immediately upon their touch with the original nylon; FIGS. 7B and 7C demonstrate that the coated nylon with PU-$M_1S_1$, and the water drops remain on the textile top before and after water washing cycles (its contact angle on is 131° and 130°, respectively). The above results sufficiently show that the textile processed by the treatment process of the invention has a good washing durability with a high water repellency.

In summation of the description above, the differences of the technology of the present invention and the prior art are listed below:

1. Since di-isocyanate is mixed into the PDMS material to form a PDMS-containing polyurethane (PU) embedded into the textile fibers after going through a predetermined manufacturing process, and a long-lasting water-repellent textile of the present invention is obtained to overcome the shortcomings of the prior art water-repellent textile having poor hand feel, durability and breathability, and thus the invention has novelty and improvement over the prior art.

2. Since the predetermined manufacturing process of the present invention is simple and easy, the present invention achieves the effects of lowering the manufacturing cost of the water-repellent textile significantly and protecting our environment, and thus the present invention is practically useful.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A water-repellent textile treatment process using a curable polydimethylsiloxane (PDMS)-containing polyurethane (PU) system, comprising the steps of:

mixing a catalyst with a PDMS diol to form a PDMS-containing material;

mixing a diisocyanate with the PDMS-containing material;

reacting the diisocyanate with the PDMS-containing material to obtain a NCO-terminated PDMS-containing PU;

adding a hydroxyl-containing acrylate to react with the NCO-terminated PDMS-containing PU to obtain a UV curable PDMS-containing PU;

mixing the UV-curable PDMS-containing PU with reactive diluents and photoinitiator uniformly;

coating a mixture of the UV-curable PDMS-containing PU, the reactive diluents and the photoinitiator onto a textile surface; and irradiating the coated textile with a UV light until the mixture of the UV-curable PDMS-containing PU is dried to obtain the long-lasting water-repellent textile, wherein the catalyst is dibutyltin dilaurate; and wherein the NCO-terminated PDMS-containing PU consists of a PU main chain and a PU side chain.

2. The system as claimed in claim 1, wherein the hydroxyl-containing acrylate is one selected from the group consisting of 2-hydroxyethylmethacrylate (HEMA), 2-hydroxyethylacrylate (HEA), 2-hydroxyethyl-1-methylcinnamate and 2-hydroxyethyl-1-methyl methacrylate.

3. The system as claimed in claim 1, wherein the diisocyanate is one selected from the group consisting of isophorone diisocyanate (IPDI), H12-methylenediphenyl diisocyanate (H12MDI), 1,-6-hexamethylene diisocyanate (HDI), 2,4-Toluene diisocyanate (TDI), 2,6-Toluene diisocyanate (TDI), methylenediphenyl diisocyanate (MDI), phenylene diisocyanate and 1,5-naphthalene diisocyanate.

4. The system as claimed in claim 1, wherein the reactive diluent is selected from the group consisting of mono-acrylate, di-acrylate, tri-acrylate, tetra-acrylate and penta-acrylate compound.

5. The system as claimed in claim 2, wherein the reactive diluent is selected from the group consisting of mono-acrylate, di-acrylate, tri-acrylate, tetra-acrylate and penta-acrylate compound.

6. The system as claimed in claim 1, wherein the PDMS diol includes (i) hydroxyalkyl-terminated PDMS of formula:

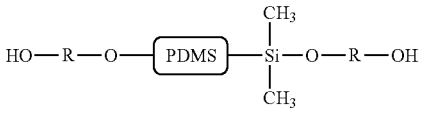

to form a PU main-chain and (ii) hydroxyalkyl-terminated PDMS of formula:

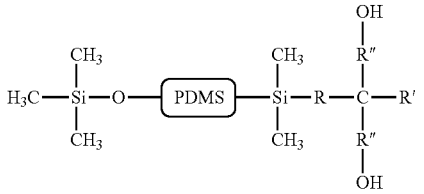

to form a PU side-chain; wherein R, R' and R" are alkyl groups.

7. The system as claimed in claim 6, wherein the PDMS diol is a mixture of (i) and (ii) in a ratio of 1:1.

* * * * *